US005441841A

United States Patent [19]

Larson et al.

[11] Patent Number: 5,441,841

[45] Date of Patent: Aug. 15, 1995

[54] LIQUID DEVELOPER COMPOSITIONS WITH BLOCK COPOLYMERS

[75] Inventors: James R. Larson, Fairport; John W. Spiewak, Webster; George A. Gibson, Fairport, all of N.Y.

[73] Assignee: Xerox Corporation, Stamford, Conn.

[21] Appl. No.: 249,827

[22] Filed: May 26, 1994

[51] Int. Cl.[6] ..... G03G 9/135

[52] U.S. Cl. ..... 430/115; 430/117

[58] Field of Search ..... 430/115, 114, 117

[56] References Cited

U.S. PATENT DOCUMENTS

| | | | |
|---|---|---|---|
| 4,707,429 | 11/1987 | Trout | 430/115 |
| 5,019,477 | 5/1991 | Felder | 430/115 |
| 5,030,535 | 7/1991 | Drappel et al. | 430/116 |
| 5,035,972 | 7/1991 | El-Sayed et al. | 430/115 |
| 5,130,221 | 7/1992 | El-Sayed et al. | 430/115 |
| 5,290,653 | 3/1994 | Pearlstine | 430/115 |
| 5,306,591 | 4/1994 | Larson et al. | 430/115 |
| 5,308,731 | 5/1994 | Larson et al. | 430/115 |

*Primary Examiner*—Christopher D. RoDee
*Attorney, Agent, or Firm*—E. O. Palazzo

[57] ABSTRACT

A liquid developer comprised of a liquid, thermoplastic resin particles, optional pigment, a nonpolar liquid soluble charge director comprised of an ionic or zwitterionic quaternary ammonium block copolymer, and wherein said charge director possesses a molecular weight distribution that is bimodal comprising a first AB diblock copolymer component with a number average molecular weight of from about 70,000 to about 200,000, and a second AB diblock copolymer component with a number average molecular weight of from about 2,200 to about 60,000.

28 Claims, No Drawings

LIQUID DEVELOPER COMPOSITIONS WITH BLOCK COPOLYMERS

BACKGROUND OF THE INVENTION

This invention is generally directed to liquid developer compositions and, more specifically, to liquid developers containing a bimodal molecular weight distribution ionic or zwitterionic ammonium block copolymers with a bimodal molecular weight distribution. More specifically, in embodiments the present invention relates to liquid developers with charge directors derived from alkylation or protonation of poly-2-ethylhexyl methacrylate-co-N',N'-dimethylamino-2-ethylmethacrylate (EHMA-DMAEMA) A-B diblock copolymers which form inverse micelles with the ammonium ionic or polar end of the block copolymer faced inward, and the nonpolar EHMA tail pointing in a direction outward toward the hydrophobic hydrocarbon vehicle selected for the liquid developer; and wherein the molecular weight distribution of the charge director is bimodal comprising a component with a number average molecular weight (determined by dividing the number of moles of monoinitiator into the number of grams of acrylic monomer being initiated by the charged molar quantity of monoinitiator) of from about 70,000 to about 200,000, preferably from about 80,000 to about 150,000, and more preferably about 85,000 to about 100,000, and a second component with a number average molecular weight of from about 2,200 to about 60,000, preferably from about 3,000 to about 20,000, and more preferably from about 4,000 to 10,000. Effective ratios of the high $M_n$ (number average molecular weight) over the low $M_n$ components ranges from 99/1 to 10/90 with a preferred range being 95/5 to 50/50. With the aforementioned molecular weight distribution, there are enabled liquid developers with a number of advantages such as high particle charge with a controlled range of low conductivities. The low conductivities result from the larger micelles which result from the high molecular weight component of the charge director. The large micelle reduces the conductivity in, for example as follows: 1) the electrophoretic mobility is reduced as the size of the micelle increases due to viscous drag; 2) as the size of the micelle increases, the number of micelles decreases at the same total mass loading of the charge director resulting in a decrease in the micelle charge density. Furthermore, it has been shown that these charge directors with selected molecular weight distributions result in low conductivity liquid toner dispersions with stable high particle charge over a range in low conductivities. For example, the charge director with the selected bimodal molecular weight distributions result in particle mobilities which vary from about 2.6 to 2.8 E-10 $m^2/Vs$ over a conductivity (of 1 percent solids liquid toner dispersion) of from about 2 to 8 ps/centimeter. In contrast, the use of a low molecular weight monomodal molecular weight distribution charge director results in a mobility variation of about 0.2 to 2.5 E-10 $m^2/Vs$ over the same conductivity range.

The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after substantial research efforts, and which toners result in, for example, sufficient particle charge for transfer and maintain the mobility within the desired range of the particular imaging system employed. Advantages associated with the present invention include a high developer particle charge over a range of low conductivities; and further increasing the desired negative charge on the developer particles and in embodiments providing a charge director that is superior to similar charge directors like tetraalkyl quaternary ammonium block copolymers, lecithin, and metal salts of petroleum fractions. Some of the aforementioned additives like lecithin contain impurities which can have an adverse effect on their intended function. The superior charge can result in improved image development and superior image transfer. The low conductivity of the dispersions obtained with the present invention improve the developability of the liquid toner dispersion as the high concentration of mobile ions in high conductivty liquid dispersions compete with the toner particles for the latent electrostatic image in the xerographic process. The high concentration of mobile ions, reduced with the present invention, can also disrupt other steps in the xerographic printing process such as the electrostatic transfer of the image from the image bearing member to a substrate. In a number of applications of the xerographic printing process, a subsequent electrostatic image is applied to the image bearing member over a previously developed image. In this process, often referred to as an image-on-image process, a high concentration of mobile ions in the first image would distort the electrostatic latent image being developed in the subsequent development. The desired low conductivity for any given electrostatic printing process will depend on specific features of the printing system and it is, therefore, desirable to have a liquid toner dispersion with an adjustable low conductivity which provides high particle charges over a range of low conductivities.

A latent electrostatic image can be developed with toner particles comprised of resin, pigment, and charge adjuvant dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin, colorant like pigment or dye, and a dispersant nonpolar liquid. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as measured as determined by the Horiba Capa 500 or 700 particle sizers.

Since the formation of images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles, may be selected from known thermoplastics, including fluoropolymers.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer, and the compatible segment thereof is oriented to be compatible with other resins and a coloring agent contained in the toner whereby the toner is provided with both liquid repelling and solvent soluble properties.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009 and 5,034,299.

The disclosures of each of the U.S. patents mentioned herein are totally incorporated herein by reference.

In copending U.S. patent application Ser. No. 986,316 the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,306,591, there is disclosed a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

In copending U.S. patent application Ser. No. 185,341, the disclosure of which is totally incorporated herein by reference, there is illustrated a liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

In copending U.S. patent application Ser. No. 249,916, filed concurrently herewith and the disclosure of which is totally incorporated herein by reference, there is illustrated a liquid developer comprised of a liquid, thermoplastic resin particles, a nonpolar liquid soluble charge director comprised of an ionic or zwitterionic quaternary ammonium block copolymer ammonium block copolymer, and wherein the number average molecular weight thereof of said charge director is from about 70,000 to about 200,000.

SUMMARY OF THE INVENTION

It is an object of the present invention to provide liquid developers with many of the advantages illustrated herein.

Another object of the present invention is to provide liquid developers capable of high particle charging and fast toner charging rates.

Further, another object of the present invention is to provide liquid developer with high particle charges and low conductivities.

Another object of the invention is to provide a negatively charged liquid developer wherein there is selected as charge directors ionic and/or zwitterionic ammonium AB diblock copolymers, and which copolymer has an important molecular weight distribution which is bimodal comprising an AB diblock component with a number average molecular weight (determined by dividing the number of moles of monoinitiator into the number of grams of acrylic monomer being initiated by the charged molar quantity of monoinitiator) is from about 70,000 to about 200,000, preferably from about 80,000 to about 150,000, and more preferably about 85,000 to 100,000, and a second AB diblock component with a number average molecular weight $M_n$ is from about 2,200 to about 6,000, preferably from about 3,000 to about 20,000, and more preferably about 4,000 to 10,000. Effective ratios of the high $M_n$ over the low $M_n$ components range from 99/1 to 10/90, with a preferred range of 95/5 to 50/50, wherein A is considered the polar ionic block like an ammonium containing segment and B is considered the nonpolymer block like 2-ethylhexylmethacrylate. Examples of acceptable conductivity and mobility ranges for developers charged with the bimodal molecular weight distribution charge directors of this invention are illustrated herein. Conductivities measured at ambient temperature (21° C. to 23° C.) for developers containing one percent toner solids are considered high in the 10 to 20 pmhos/centimeter range and very high at greater than 20 pmhos/centimeter. Optimum conductivities are less than about 10 pmhos/centimeter and preferably less than about 5 ps/centimeter. As conductivities increase above the optimum range, excess ions can compete with toner particles of the same charge for development of the latent image giving rise to low developed mass resulting in low print density images. In addition to having an optimum conductivity of less than 10 pmho/centimeters, the liquid toner or developer of this invention also possesses a mobility of at least $-1.5\times10^{-10}$ $m^2/Vs$ and preferably greater than $-2.5\times10^{-10}$ $m^2/Vs$ in embodiments.

It is still a further object of the invention to provide a liquid developer wherein developed image defects such as smearing, loss of resolution and loss of density are eliminated, or minimized.

It is another object of the invention to provide low conductivity liquid developers which will be effective in an image-on-image xerographic printing process where an image is developed on a latent image bearing member in the xerographic process and then that image bearing member is passed through the xerographic charging, imagewise discharging, and development steps to develop a multilayered image. The subsequent development steps can be accomplished with liquid toner dispersions of colors different than the first or previous development resulting in a multicolored image which can be transferred from an imaging member to a substrate.

Also, in another object of the present invention there are provided negatively charged liquid developers with certain bimodal molecular weight distribution ionic and/or zwitterionic ammonium AB diblock copolymer charge directors, which are superior in embodiments to, for example, monomodal molecular weight distribution ammonium block copolymers since, for example, the bimodal directors result in high negative toner particle charge over a wider range of low conductivity. For example, the charge director with the selected bimodal molecular weight distributions results in particle mobilities which vary from 2.6 to 2.8 E-10 $m^2/Vs$ over a conductivity (of 1 percent solids liquid toner dispersion) from 2 to 8 ps/centimeter. In contrast, the use of a low molecular weight monomodal molecular weight distribution charge director results in a mobility variation of 0.2 to 2.5 E-10 $m^2/Vs$ over the same conductivity range.

Also, in another object of the present invention there are provided negatively charged liquid developers with certain bimodal molecular weight distribution ionic and/or zwitterionic ammonium AB diblock copolymer charge directors, which are superior in embodiments to, for example, monomodal molecular weight, low molecular weight ionic and/or zwitterionic ammonium AB diblock copolymers since, for example, the bimodal directors result in high negative particle charge over a wider range of low conductivity.

Another object of the present invention resides in the provision of negatively charged liquid toners with bimodal molecular weight distribution ionic and/or zwitterionic ammonium block copolymers, and wherein in embodiments enhancement of the negative charge of NUCREL ® based toners, especially cyan and magenta toners, is enhanced.

These and other objects of the present invention can be accomplished in embodiments by the provision of liquid developers with certain charge directors. In embodiments, the present invention is directed to liquid developers comprised of a toner resin, pigment, charge additive and a charge director comprised of a bimodal molecular weight distribution ionic and/or zwitterionic ammonium block copolymers. In embodiments, the aforementioned charge director contains a polar ammonium A block and a second B block, constituent or component that is nonpolar thereby enabling hydrocarbon solubility, and which AB diblock copolymers can be obtained from group transfer polymerization, and a subsequent polymer modification reaction of the group transfer prepared AB diblock copolymer in which the ionic or zwitterionic site is introduced into the polar A block and wherein the molecular weight distribution is bimodal comprising a component with a number average molecular weight, determined by dividing the number of moles of monoinitiator into the number of grams of acrylic monomer being initiated by the charged molar quantity of monoinitiator, is from about 70,000 to about 200,000, preferably from about 80,000 to about 150,000, and more preferably about 85,000 to 100,000 and a second AB component with a number average molecular weight of from about 2,200 to about 6,000, preferably from about 3,000 to about 20,000, and more preferably about 4,000 to 10,000. Effective ratios of the high $M_n$ over the low $M_n$ components ranges from 99/1 to 10/90, with a preferred range of 95/5 to 50/50.

Embodiments of the present invention relate to a developer comprised of a liquid, thermoplastic resin particles, and a nonpolar liquid soluble ammonium block copolymer charge director; and a liquid electrostatographic developer comprised of (A) a nonpolar liquid having a Kauri-butanol value of from about 5 to about 30, and present in a major amount of from about 50 percent to about 95 weight percent; (B) thermoplastic resin particles having an average volume particle diameter of from about 5 to about 30 microns; (C) a nonpolar liquid soluble bimodal molecular weight distribution ionic or zwitterionic ammonium block copolymer; and (D) optionally a charge adjuvant.

Suitable charge directors of the present invention can be represented by the formula

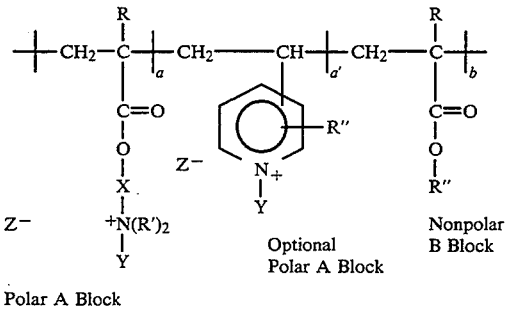

wherein R is hydrogen, alkyl, aryl, or alkylaryl; R′ is alkyl, aryl, cycloalkyl, cycloalkylenyl cycloalkylalkyl, cycloalkylaryl or alkylaryl with or without heteroatoms; R″ is, alkyl, aryl, cycloalkyl, cycloalkylalkyl, cycloalkylaryl or alkylaryl with or without heteroatoms; R‴ is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms and Y is hydrogen, alkyl of 1 to about 25 carbon atoms; alkylaryl and aryl from 6 to about 30 carbon atoms with or without heteroatoms; Z- is an anion such as bromide, hydroxide, chloride, nitrate, p-toluenesulfonate, sulfate, phosphate, fluoride, dodecylsulfonate, dodecylbenzenesulfonate, acetate, trifluroacetate, chloroacetate, stearate, and the like. For the high molecular weight component of the bimodal molecular weight distribution, $aM_a+a'M_{a'}$ is about 3,500 to 120,000 and $bM_b$ is 28,000 to 190,000, and for the low molecular weight distribution $aM_a+a'M_{a'}$ is about 200 to 10,000 and $bM_b$ is 2,000 to 50,000 wherein a, a′ and b are the number average degree of polymerization (DP) and $M_a$, $M_{a'}$ and $M_b$ are the corresponding repeat unit molecular weights. Effective ratios of the high $M_n$ over the low $M_n$ components ranges from 99/1 to 10/90, with a preferred range of 95/5 to 50/50. Alkyl includes groups with 1 to about 25 carbon atoms; aryl includes groups with from 6 to about 24 carbon atoms and alkylene can include groups with from 1 to about 25 carbon atoms.

Examples of specific diblock copolymer charge directors include poly[2-trimethylammoniumethyl methacrylate bromide co-2-ethylhexyl methacrylate], poly[2-triethylammoniumethyl methacrylate hydroxide co-2-ethylhexyl methacrylate], poly[2-trimethylammoniumethyl methacrylate chloride co-2-ethylhexyl methacrylate], poly[2-trimethylammoniumethyl methacrylate fluoride co-2-ethylhexyl acrylate], poly[2-trimethylammoniumethyl acrylate p-toluenesulfonate co-2-ethylhexyl methacrylate], poly[2-trimethylammoniumethyl acrylate nitrate co-2-ethylhexyl acrylate], poly[2-triethylammoniumethyl methacrylate phosphate co-2-ethylhexyl acrylate], poly[2-triethylammoniumethyl acrylate bromide co-2-ethylhexyl acrylate], poly[2 -trimethylammoniumethyl methacrylate hydroxide co-2-ethylhexyl acrylate], poly[2-trimethylammoniumethyl acrylate hydroxide co-2-ethylhexyl acrylate], poly[2-trimethylammoniumethyl methacrylate hydroxide co-N,N-dibutyl methacrylamide], poly[2-triethylammoniumethyl methacrylate chloride co-N,N-dibutyl methacrylamide], poly[2-trimethylammoniumethyl methacrylate bromide co-N,N-dibutylacrylamide], poly[2-triethylammoniumethyl methacrylatehydroxide co-N,N-dibutylacrylamide], poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate, poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

Other examples of diblock copolymer charge directors include poly[4-vinyl-N,N-dimethylanilinium bromide co-2-ethylhexyl methacrylate], poly[4-vinyl-N,N-dimethylanilinium tosylate co-2-ethylhexyl methacrylate], poly[ethylenimmonium bromide co-2-ethylhexyl methacrylate], poly[propylenimmonium bromide co-2-ethylhexyl methacrylate], poly[4-vinyl-N,N-trimethylanilinium bromide co-2-ethylhexyl methacrylate], poly[4-vinyl-N,N-triethylanilinium chloride co-2-ethylhexyl methacrylate], poly[quaternary ethylenimmonium fluoride co-2-ethylhexyl methacrylate], poly[quaternary propylenimmonium hydroxide co-2-ethylhexyl methacrylate], and polyvinyl-N-ethyl-pyridinium nitrate-co-p-dodecylstyrene.

A preferred ammonium AB diblock copolymer charge director of the present invention contains a polar A block with a positively charged ammonium nitrogen and a nonpolar B block which has sufficient aliphatic content to enable the block copolymer to more effectively dissolve in a nonpolar liquid having a Kauributanol value of less than about 30. The A block for the high molecular weight component of the bimodal molecular weight distribution has, for example, a number average molecular weight range of from about 3,500 to about 120,000, and the A block for the low molecular weight component of the bimodal molecular weight distribution has, for example, a number average molecular weight range of from about 200 to about 10,000, and the B block of the high molecular weight component of the bimodal molecular weight distribution has a number average molecular weight range of from about 28,000 to about 190,000, and the B block of the low molecular weight component of the bimodal molecular weight distribution has a number average molecular weight range of from about 2,000 to about 50,000. Number average degree of polymerization (DP) refers to the average number of monomeric units per polymer chain. It is related to the number average molecular weight ($M_n$) by the formula $M_n=M_0\times DP$, where $M_0$ is the molecular weight of the monomer. Amine nitrogen alkylation to form the ammonium salt in the polar A block for satisfactory acceptable charge director performance is in embodiment at least 80 mole percent and preferably at least 90 mole percent. Effective ratios of the high $M_n$ over the low $M_n$ components ranges from 99/1 to 10/90, with a preferred range of 95/5 to 50/50.

In embodiment, the AB ammonium diblock charge director is composed of A and B blocks, wherein the A block is an alkyl, aryl or alkylaryl amine containing polymer wherein the alkyl, aryl, or alkylaryl moiety can be substituted or unsubstituted. Useful A blocks are polymers prepared from at least one monomer selected from the group consisting of 1) $CH_2=CRCO_2R^1$ wherein R is hydrogen, alkyl, aryl, or alkylaryl of 1 to 20 carbons and $R^1$ is alkyl of 1 to 20 carbons wherein the terminal end of $R^1$ is of the general formula $-N(R^2)_3X$- where N is nitrogen, $R^2$ is alkyl, cycloalkyl, aryl, or alkylaryl of 1 to 20 carbons, X- is an anion such as OH-, Cl-, Br-, p-toluene sulfonate, dodecylsulfonate, nitrate, phosphate, etc; and 2) 2, 3, or 4-vinylpyridinium salt wherein the ring carbon atoms not substituted with the vinyl group are substituted with $R^2$ and the ring nitrogen is substituted with R as defined above. Examples of monomers useful as A blocks include 2-(N,N-trimethylammonium hydroxide)ethyl methacrylate, 2-(N,N-triethylammonium bromide)ethyl methacrylate, 2-(N,N-trimethylammonium chloride)ethyl acrylate, 2-(N,N-trimethylammonium p-toluene-sulfonate)ethyl methacrylate, 4-vinyl-N-methyl-pyridinium p-toluene sulfonate, 2-vinyl-N-ethylpyridinium acetate-3-vinyl-N-methyl-pyridinium bromide, and the like. Useful B blocks are polymers prepared from at least one monomer selected from the group consisting of butadiene, isoprene, and compounds of the general formulas, $CH_2=CHR^3$, $CH_2=CHCO_2R^3$, $CH_2=CRCO_2R^3$, where $R^3$ is alkyl of about 6 to about 30 carbons, or alkylaryl of 8 to 30 carbons. Examples of monomers useful in preparing B blocks include 2-ethylhexylmethacrylate, laurylmethacrylate, stearylmethacrylate, butadiene, isoprene, 1-dodecene, 2-ethylhexylacrylate, p-tert butylstyrene, and the like. Aryl includes 6 to about 30 carbon atoms, such as phenyl, benzyl, naphthyl and the like, and alkyl includes methyl, ethyl, propyl, butyl, pentyl, and the like.

Suitable nonpolar liquid soluble charge director compound examples selected for the developers of the present invention in various effective amounts, such as from about 0.5 to about 100 weight percent of developer solids, which is also represented as 5 milligrams to 1,000 milligrams of charge director solids to 1 gram of developer solids, and preferably 1 percent to 20 percent by weight relative to developer solids, which is also referred to as 10 milligrams to 200 milligrams of charge director solids to 1 gram of developer solids, include zwitterionic AB diblock copolymers represented by the following formula

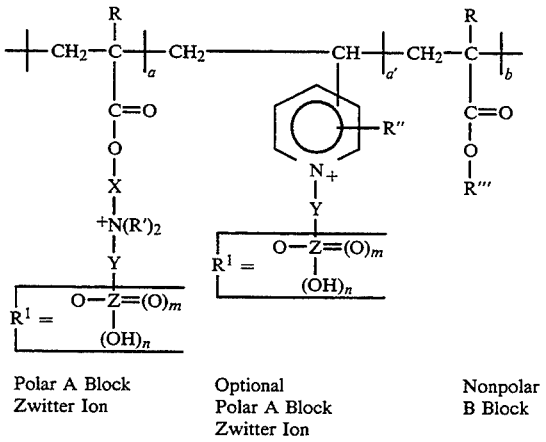

wherein R is hydrogen, alkyl, aryl, or alkylaryl; $R^1$ is a conjugate oxygen containing acid anion derived from carbon, sulfur, or phosphorus; Z is carbon (C), sulfur (S), phosphorus (P), or substituted phosphorus (P-R with R defined as above) and m is 1 or 2 doubly bonded oxygen atoms and n is 0 or 1 hydroxyl groups; R' is alkyl, aryl, cycloalkyl, cycloalkylenyl cycloalkylalkyl, cycloalkylaryl or alkylaryl with or without heteroatoms; R'' is alkyl, aryl, cycloalkyl, cycloalkylalkyl, cycloalkylaryl or alkylaryl with or without heteroatoms; R''' is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms; and Y is alkylene or arylalkylene of 1 to 10 carbons with or without heteroatoms. For the high molecular weight component of the bimodal molecular weight distribution, $aM_a+a'M_{a'}$ is about 3,500 to 120,000 and $bM_b$ is 28,000 to 190,000, and for the low molecular weight component of the bimodal molecular weight distribution, $aM_a+a'M_{a'}$ is about 200 to 10,000 and $bM_b$ is 2,000 to 50,000 wherein a, a' and b are the number average degree of polymerization (DP) and Ma, $M_{a'}$ and $M_b$ are the corresponding repeat unit molecular weights. Alkyl includes groups with 1 to about 25 carbon atoms; aryl includes groups with from 6 to about 24 carbon atoms; and alkylene can include groups with from 1 to about 25 carbon atoms. Effective ratios of the high $M_n$ over the low $M_n$ components ranges from 99/1 to 10/90, with a preferred range of 95/5 to 50/50.

Examples of specific zwitterionic diblock copolymer charge directors include poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2ethylhexyl methacrylate-co-N,N-dimethyl-N-propylenephosphinate-N-ammoniumethyl methacrylate), poly(2-ethylhexyl methacrylate-co-N,N-dimethyl-N-propylenesuifinate-N-ammoniumethyl methacrylate), poly(2ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammonimethyl methacrylate), and poly(N,N-dibutylmethacrylamido-co-N,N-dimethyl-N-propylenesulfinate-N-ammoniumethyl methacrylate). In all of the above examples, the corresponding acrylate copolymer, instead of the methacrylate copolymer, could also be employed as suitable nonpolar liquid soluble zwitterionic AB diblock copolymer charge directors. Additional suitable examples of nonpolar liquid soluble zwitterionic AB diblock copolymer charge directors include poly(4-vinylpyridinium-N-methylenecarboxylate-co-2-ethylhexyl methacrylate), poly(4-vinylpyridinium-N-propylenesulfonate-co-2-ethylhexyl methacrylate), poly(4-vinylpyridinium-N- propylenephosphonate-co-2-ethylhexyl methacrylate), poly(4-vinylpyridinium-N-propylenephosphinate-co-2-ethylhexyl methacrylate), poly(4-vinylpyridinium-N-propylenesulfinate-co-2-ethylhexyl methacrylate), poly(4-vinylpyridinium-N-ethyleneoxyethylenecarboxylate-co-2-ethylhexyl methacrylate), poly(4-vinylpyridinium-N-ethyleneoxyethylenesulfonate-co-2-ethylhexyl methacrylate), poly(4-vinylpyridinium-N-ethyleneoxyethylenephosphonate-co-2-ethylhexyl methacrylate), poly[4-vinylpyridinium-N-methylenecarboxylate-co-p-tert butylstyrene), and the like. In the aforementioned pyridinium examples, additional examples of nonpolar liquid soluble zwitterionic AB diblock copolymer charge directors include poly(2-vinylpyridinium-N-methylenecarboxylate-co-2-ethylhexyl methacrylate), poly(2-vinylpyridinium-N-propylenesulfonate-co-2-ethylhexyl methacrylate), poly(2-vinylpyridinium-N-propylenephosphonate-co-2-ethylhexyl methacrylate), poly(2-vinylpyridinium-N-propylenephosphinate-co-2-ethylhexyl methacrylate), poly(2-vinylpyridinium-N-propylenesulfinate-co-2-ethylhexyl methacrylate), poly(2-vinylpyridinium-N-ethyleneoxyethylenecarboxylate-co-2-ethylhexyl methacrylate), poly(2-vinylpyridinium-N-ethyleneoxyethylenesulfonate-co-2-ethylhexyl methacrylate), poly(2-vinylpyridinium-N-ethyleneoxyethylenephosphonate-co-2-ethylhexyl methacrylate), poly[3-vinylpyridinium-N-methylenecarboxylate-co-p-tertiary butylstyrene) and poly(3-vinylpyridinium-N-methylenecarboxylate-co-2-ethylhexyl methacrylate), poly(3-vinylpyridinium-N-propylenesulfonate-co-2-ethylhexyl methacrylate), poly(3-vinylpyridinium-N-propylenephosphonate-co-2-ethylhexyl methacrylate), poly(3-vinylpyridinium-N-propylenephosphinate-co-2-ethylhexyl methacrylate), poly(3-vinylpyridinium-N-propylenesulfinate-co-2-ethylhexyl methacrylate), poly(3-vinylpyridinium-N-ethyleneoxyethylenecarboxylate-co-2-ethylhexyl methacrylate), poly(3-vinylpyridinium-N-ethyleneoxyethylenesulfonate-co-2-ethylhexyl methacrylate), poly(3-vinylpyridinium-N-ethyleneoxyethylenephosphonate-co-2-ethylhexyl methacrylate), poly(3-vinylpyridinium-N-methylenecarboxylate-co-p-tertiary butylstyrene), and the like.

A preferred repeat unit content of the polar A block is 60 to 5 mole percent and is more preferably at 40 to 10 mole percent, and the preferred repeat unit content of the nonpolar B block is 40 to 95 mole percent and is more preferably at 60 to 90 mole percent. Amine nitrogen alkylation to form the zwitterionic ammonium polar A block repeat unit wherein both cationic and anionic sites are covalently bonded within the same polar repeat unit should be at least 80 mole percent and preferably at least 90 mole percent for satisfactory charge director performance. The polar A block may be comprised entirely of either of the polar blocks illustrated herein or it may be complex wherein the optional polar A block repeat unit may be 0.1 to 99.9 mole percent of all the polar A block repeat units present. The complex polar A block may be segmented, tapered or random when it contains more than one repeat unit.

In another embodiment, the AB zwitterionic ammonium diblock charge director is composed of A and B blocks as illustrated hereinafter. The polar A block is an alkyl, aryl or alkylaryl amine containing polymer wherein the alkyl, aryl, or alkylaryl moiety can be substituted or unsubstituted and be cyclic or noncyclic. Useful A blocks are polymers prepared from at least one monomer selected from the group consisting of $CH_2=CRCO_2R^1$ wherein R is hydrogen, alkyl, aryl, or alkylaryl, and $R^1$ is a conjugate acid monoanion wherein m=0 to 2 and n=0 to 2 and Z is carbon, sulfur, or phosphorus. Specific examples of $R^1$ groups include carboxylate, sulfonate, sulfinate, phosphonate, phosphinate, phosphate and sulfate. X and Y are alkylene or arylalkylene with or without heteroatoms wherein X contains, for example, 2 to 10 carbon atoms and Y contains, for example, 1 to 10 carbon atoms. Examples of X groups include 1,2-ethylene, 1,3-propylene, 1,2-propylene, 1,4-butylene, 1,6-hexylene, 1,10-decamethylene, 3,3,5,5-tetramethylhexylene, 1,4-cis or trans dimethylenecyclohexylene, 1,4-phenylenedimethylene, and 1-ethyleneoxy-5-ethylene. Examples of Y groups include methylene, 1-ethylene-2-oxy and all of the above cited X groups. R′ is alkyl, aryl, cycloalkyl, cycloalkylenyl, cycloalkylalkyl, cycloalkylaryl or alkylaryl of 1–20 carbons with or without heteroatoms. Suitable R′ groups include methyl, ethyl, allyl, hexyl, lauryl, cetyl, stearyl, 2-ethoxyethyl, benzyl, phenethyl, 1-methylenenaphthyl, cyclohexyl, cyclohexylmethylene, cyclopentylene, cyclohexylene, 4-ethylcyclohexyl, 4-cyclohexylbenzyl, 4-ethylbenzyl, 4-methoxybenzyl, and 4-nitrobenzyl. R″ is alkyl, aryl, cycloalkyl, cycloalkylalkyl, cycloalkylaryl or alkylaryl with or without heteroatoms. Suitable R″ groups include methyl, ethyl, allyl, butyl, isoamyl, methoxyl, phenyl, benzyl and cyclohexyl.

Examples of useful polar A block monomers, selected in the preferred monomer range of 60 to 5 mole percent, which after copolymerization to unquaternized A block precursors that are subsequently quaternized to zwitterionic quaternary ammonium polar A block copolymers, include N,N-dimethylamino-N-2-ethylmethacrylate, N,N-diethylamino-N-2-ethylmethacrylate, N,N-dimethylamino-N-2-ethylacrylate, N,N-diethylamino-N-2-ethylacrylate, N-morpholino-2-ethyl methacrylate, 4-vinylpyridine, 3-vinylpyridine, and 2-vinylpyridine. Examples of monomers which after copolymerization give useful A blocks directly include N,N,dimethyl-N-methylenecarboxylate-N-ammoniumethyl methacrylate, N,N-diethyl-N-methylenecarboxylate-N-ammoniumethyl methacrylate, N,N-dimethyl-N-propylenesulfonate-N-ammoniumethyl methacrylate, N,N-dimethyl-N-methylenecarboxylate-N-ammoniumethyl acrylate, N,N-dimethyl-N-propylenesulfonate-N-ammoniumethyl acrylate, N,N-dimethyl-N-butylenephosphonate-N-ammoniumethyl methacrylate, N,N-dimethyl-N-butylenephosphinate-N-ammoniumethyl methacrylate, N,N-morpholino-N-methylenecarboxylate-N-ammoniumethyl methacrylate, N,N-morpholino-N-propylenesulfonate-N-ammoniumethyl methacrylate, 4-vinyl-N-methylene pyridinium carboxylate, 4-vinyl-N-propylenepyridinium sulfonate, 4-vinyl-N-butylenepyridinium phosphonate, 2-vinyl-N-methylene pyridinium carboxylate, 3-vinyl-N-methylene pyridinium carboxylate, and the like.

Examples of useful nonpolar B block monomers, selected in the preferred range of 40 to 95 mole percent, provide polymers prepared from at least one B block monomer selected from the group consisting of butadiene, isoprene, chloroprene, mycrene, and compounds of the general formulas $CH_2=CHR'''$, $CH_2=CHCO_2R'''$, $CH_2=CRCO_2R'''$, where R''' is alkyl, aryl, cycloalkyl, cycloalkylalkyl, cycloalkylaryl or alkylaryl with or without heteroatoms of 4 to 20 carbons. Examples of monomers useful in preparing the B blocks include 2-ethylhexyl methacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, mycrene, 1-dodecene, p-tert butylstyrene, and the like. Optional useful nonpolar B blocks are polymers prepared from at least one monomer selected from the group consisting of $CH_2=CHCON(R')_2$ and $CH_2=CRCON(R')_2$ where R and R' are as indicated herein.

The charge director can be selected for the liquid developers in various effective amounts, such as for example from about 0.5 percent to 100 percent by weight relative to developer solids and preferably 1 percent to 20 percent by weight relative to developer solids. Developer solids includes toner resin, pigment, and optional charge adjuvant. Without pigment, the developer may be selected for the generation of a resist, or a printing plate. Effective ratios of the high $M_n$ over the low $M_n$ components ranges from 99/1 to 10/90, with a preferred range of 95/5 to 50/50.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/centimeter, or more. Preferably, the liquid selected in embodiments is a branched chain aliphatic hydrocarbon. A nonpolar liquid of the ISOPAR ® series available from the Exxon Corporation may also be used for the developers of the present invention. These hydrocarbon liquids are considered narrow portions of isoparaffinic hydrocarbon fractions with extremely high levels of purity. For example, the boiling range of ISOPAR G ® is between about 157° C. and about 176° C.; ISOPAR H ® is between about 176° C. and about 191° C.; ISOPAR K ® is between about 177° C. and about 197° C.; ISOPAR L ® is between about 188° C. and about 206° C.; ISOPAR M ® is between about 207° C. and about 254° C.; and ISOPAR V ® is between about 254.4° C. and about 329.4° C. ISOPAR L ® has a mid-boiling point of approximately 194° C. ISOPAR M ® has an auto ignition temperature of 338° C. ISOPAR G ® has a flash point of 40° C. as determined by the tag closed cup method; ISOPAR H ® has a flash point of 53° C. as determined by the ASTM D-56 method; ISOPAR L ® has a flash point of 61° C. as determined by the ASTM D-56 method; and ISOPAR M ® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR ® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR ® series available from Exxon Corporation, the SOLTROL ® series available from the Phillips Petroleum Company, and the SHELLSOL ® series available from the Shell Oil Company can be selected. Other useful liquid include mineral oils such as the SUPURLA ® series available from the Amoco Oil Company.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX ® resins, E.I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE ® DPD 6169, DPDA 6182 Natural (Union Carbide Corporation); ethylene vinyl acetate resins, for example DQDA 6832 Natural 7 (Union Carbide Corporation); SURLYN ® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid; and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE ® acrylic resins (E.I. DuPont de Nemours and Company); or blends thereof. Preferred copolymers are the copolymer of ethylene and an $\alpha$-$\beta$-ethylenically unsaturated acid of either acrylic acid or methacrylic acid. In a preferred embodiment, NUCREL ® like NUCREL ® 599, NUCREL ® 699, or NUCREL ® 960 can be selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330 ®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901 F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps like aluminum or magnesium stearate or octoate, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives can be comprised of the metal catechol and aluminum hydroxyacid complexes illustrated in U.S. Pat. No. 5,306,591 and U.S. Pat. No. 5,308,731, the disclosures of which are totally incorporated herein by reference, and which additives in combination with the charge directors of the present invention have the following advantages over the aforementioned prior art charge additives: improved toner charging characteristics, namely an increase in particle charge, as measured by ESA mobility, from $-1.4$ E-10 $m^2/Vs$ to $-2.3$ E-10 $m^2/Vs$, that results in improved image development and transfer, from 80 percent to 93 percent, to allow improved solid area coverage, from transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer. Other charge adjuvants can be selected, such as those illustrated in copending patent application, especially ALHOS, U.S. Pat. No. 5,366,840, the disclosure of which is totally incorporated herein by reference. More specifically, there is illustrated in this copending patent application a liquid developer comprised of thermoplastic resin particles, an optional charge director, and a charge additive or adjuvant comprised of a component of the formulas

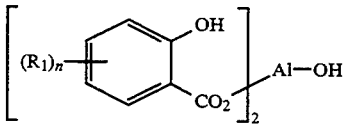

or

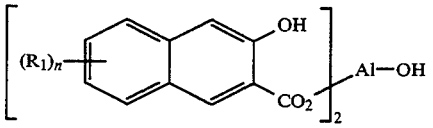

wherein $R_1$ is selected from the group consisting of hydrogen and alkyl, and n is 0 (zero), 1, 2, 3, or 4.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin, nonpolar liquid charging additive and colorant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media is particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image.

The invention will further be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sinewave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 millivolts for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer manufactured by Horiba Instruments, Inc., Irvine, Calif.

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided.

EXAMPLE I

LIQUID TONER PREPARATION 1 [26270-52]

One hundred and seventy five (175.0) grams of NUCREL 599 ®, a copolymer of ethylene and methacrylic acid with a melt index at 190° C. of 500 dg/minute, available from E.I. DuPont de Nemours & Company, Wilmington, Del., 45.4 grams of the cyan pigment PV FAST BLUE TM, 6.8 grams of aluminum stearate WITCO 22 TM, available from Witco Company and 307.4 grams of NORPAR 15 ®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 86° to 96° C. for 2 hours and cooled by running water through the attritor jacket to 16° C. An additional 980.1 grams of NORPAR 15 ® were added, and ground in the attritor for an additional 4.5 hours. An additional 1,536 grams of NORPAR 15 ® were added and the mixture was separated by the use of a metal grate from the steel balls yielding a liquid toner concentrate of 7.13 percent solids wherein solids include resin, charge adjuvant, and pigment, and 92.87 percent of NORPAR 15 ®. The particle diameter was 2.12 microns average by area as measured with a Horiba Cappa 500. This toner concentrate was used to formulate the liquid developer of Control 1.

EXAMPLE II

LIQUID TONER PREPARATION 2 [26643-43]

One hundred and seventy five (175.0) grams of NUCREL 599 ®, a copolymer of ethylene and methacrylic acid with a melt index at 190° C. of 500 dg/minute, available from E.I. DuPont de Nemours & Company, Wilmington, Del., 45.4 grams of the cyan pigment PV FAST BLUE TM, 6.8 grams of aluminum stearate WITCO 22 TM, available from Witco Company, and 307.4 grams of NORPAR 15 ®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 84° to 95° C. for 2 hours and cooled by running water through the attritor jacket to 21° C. An additional 980.1 grams of NORPAR 15 ® were added, and ground in the attritor for an additional 4.5 hours. An additional 1,500 grams of NORPAR 15 ® were added and the mixture was separated by the use of a metal grate from the steel balls yielding a liquid toner concentrate of 7.27 percent solids wherein solids include resin, charge adjuvant, and pigment and 92.73 percent of NORPAR 15 ®. The particle diameter was 1.76 microns, average by area as measured with a Horiba Cappa 700. This toner concentrate was selected to formulate the liquid developer of Example VIII.

EXAMPLE III

LOW MOLECULAR WEIGHT BASE POLYMER: Charged $M_n$ of 3945

There was selected a sequential Group Transfer Polymerization (GTP) of 2-ethylhexyl methacrylate (EHMA) and 2-dimethylaminoethyl methacrylate (DMAEMA) to prepare the low molecular weight AB diblock base polymer, poly[2-ethylhexyl methacrylate (B block)-co-N,N-dimethylamino-N-ethyl methacrylate (A block)]. This low molecular weight AB diblock base polymer was then used to prepare the low molecular weight protonated ammonium bromide AB diblock copolymer charge director, poly[2-ethylhexyl methacrylate (B block)-co-N,N-dimethyl-N-ethyl methacrylate ammonium bromide (A block)], described in Examples V and VI.

A 5 liter round bottom flask equipped with a magnetic stirring football, an Argon inlet and outlet, and a neutral alumina column were used for the reaction. There were charged through the alumina column, later to be replaced by a rubber septum,[which alumina column along with the reactor was maintained under a positive Argon flow and sealed from the atmosphere, 1,245 grams (6.28 mole) of freshly distilled 2-dimethylaminoethyl methacrylate monomer and 1,500 milliliters of freshly distilled (from sodium benzophenone) tetrahydrofuran (THF) solvent. Then, 78.0 milliliters (0.384 mole) of initiator, methyl trimethylsilyl dimethylketene acetal, was syringed into the reactor. The acetal was originally vacuum distilled and a middle fraction was collected and stored (under Argon) for polymerization initiation purposes. Thereafter, 0.033 milliliter of a 0.3 molar solution of tetrabutylammonium acetate (catalyst) in the same dry tetrahydrofuran was syringed into the polymerization vessel. About 1 hour after the mild exotherm peaked, there were added 270 grams (1.72 mole) of freshly distilled 2-dimethylaminoethyl methacrylate monomer through the alumina column, and the solution was magnetically stirred for 18 hours at ambient temperature. Subsequently, the tetrahydrofuran solvent was stripped with a rotoevaporator (4 hours at 40 to 60 millimeters Hg at 50° to 60° C.) and sufficient toluene solvent was added to the solid residue to complete the solvent exchange and to give a 50.86 weight percent toluene solution of the low molecular weight base polymer. The residual solid was generally stirred with toluene for about 16 to 18 hours at ambient temperature to obtain solution. This toluene solution was selected to prepare the low molecular weight protonated ammonium bromide charge director of Examples V and VI.

The above charges of initiator and monomer provide an $M_n$ (number average) and average degree of polymerization (DP) for each block. For the EHMA nonpolar B block, the charged $M_n$ is 3,242 and the DP is 16.35, and for the DMAEMA polar A block, the charged $M_n$ is 703 and the DP is 4.47. The charged total AB diblock $M_n$ is, therefore, 3,945. $^1$H-NMR analysis was obtained on a fraction of a 1 to 2 gram sample of this low molecular weight base polymer solid isolated by rotoevaporating the toluene solvent at the same rotoevaporation conditions described above. $^1$H-NMR analysis of a 17.6 percent (g/dl) $CDCl_3$ solution of the copolymer indicated 77.8 mole percent (81.55 weight percent) EHMA and 22.2 mole percent (18.45 weight percent) DMAEMA. Nonaqueous titration of the tertiary aliphatic amine group in each DMAEMA repeat unit of the polar A block of this low molecular weight base polymer indicated a composition very similar to that of the $^1$H-NMR analysis 78.26 mole percent (81.95 weight percent) EHMA by difference and 21.74 mole percent (18.05 weight percent) DMAEMA by direct titration. The nonaqueous titration composition was based on the finding of 1.148 milliequivalents of amine per gram of solid base polymer. The weight average DMAEMA content (18.23 weight percent) from both analyses in this low molecular weight base polymer was used in Examples V and VI to calculate the amount of 48 percent hydrobromic acid required to prepare the charge director.

EXAMPLE IV

HIGH MOLECULAR WEIGHT BASE POLYMER: Charged $M_n$ of 93519

There was selected a sequential Group Transfer Polymerization (GTP) of 2-ethylhexyl methacrylate (EHMA) and 2-dimethylaminoethyl methacrylate (DMAEMA) to prepare the high molecular weight AB diblock base polymer, poly[2-ethylhexyl methacrylate (B block)-co-N,N-dimethylamino-N-ethyl methacrylate (A block)]. This high molecular weight AB diblock base polymer was then used to prepare the high molecular weight protonated ammonium bromide AB diblock copolymer charge director, poly[2-ethylhexyl methacrylate (B block)-co-N,N-dimethyl-N-ethyl methacrylate ammonium bromide (A block)], described in Example VII.

To a 100 milliliter round bottom flask equipped with a magnetic stirring football, an Argon inlet and outlet, and a neutral alumina column, which alumina column along with the reactor was maintained under a positive Argon flow and sealed from the atmosphere, was charged 20 milliliters of freshly distilled (from sodium benzophenone) tetrahydrofuran (THF) solvent, 9.00 grams (0.0572 mole) of freshly distilled 2-dimethylaminoethyl methacrylate monomer and an additional 8 milliliters of the same THF to rinse down the column. Then, 0.2 milliliter of a 0.033 molar solution of tetrabutylammonium acetate (catalyst) in the same dry tetrahydrofuran was syringed into the polymerization vessel. Then, 0.11 milliliter (0.00054 mole) of initiator, methyl trimethylsilyl dimethylketene acetal, was syringed into the reactor. The acetal was originally vacuum distilled and a middle fraction was collected and stored (under Argon) for polymerization initiation purposes. About one hour after the addition of the ketene acetal initiator, the mild exotherm began to subside. After an additional hour, the contents of the 100 milliliter reactor were transferred with a dry syringe into a second reactor (500 milliliters round bottom flask similarly equipped as the first reactor), which second reactor contained 41.5 grams (0.2093 mole) of freshly distilled 2-ethylhexyl methacrylate monomer and 50 milliliters of freshly distilled tetrahydrofuran solvent also at ambient temperature. The combined reactor contents were allowed to stir for 18 hours at ambient temperature. Subsequently, the tetrahydrofuran solvent was stripped with a rotoevaporator (1 hour at 40 to 60 millimeters Hg at 50° C. to 60° C.) and sufficient toluene solvent was added to the solid residue to complete the solvent exchange and to provide a 48.14 weight percent toluene solution of the high molecular weight base polymer. The residual solid was generally stirred with toluene for about 16 to 18 hours at ambient temperature to obtain solution. This toluene solution was used to prepare the high molecular weight protonated ammonium bromide charge director described in Example VII.

The above charges of initiator and monomers provide an $M_n$ and average degree of polymerization (DP) for each block. For the EHMA nonpolar B block, the charged $M_n$ is 76,852 and the DP is 387.5, and for the DMAEMA polar A block, the charged $M_n$ is 16,667 and the DP is 106. The charged total AB diblock $M_n$ is, therefore, 93,519. $^1$H-NMR analysis was obtained on a fraction of a 1 to 2 gram sample of this high molecular weight base polymer solid isolated by rotoevaporating the toluene solvent at the same rotoevaporation conditions described above. $^1$H-NMR analysis of a 7.6 percent (g/dl) $CDCl_3$ solution of the copolymer indicated 79.5 mole percent (83.03 weight percent) EHMA and 20.5 mole percent (16.97 weight percent) DMAEMA. The 16.97 weight percent DMAEMA content was selected in Example VII to calculate the amount of 48 percent hydrobromic acid required to make the charge director.

EXAMPLE V

LOW MOLECULAR WEIGHT CHARGE DIRECTOR PREPARATION 1

Preparation of the low molecular weight protonated ammonium bromide AB diblock copolymer charge director, poly[2-ethylhexyl methacrylate (B block)-co-N,N-dimethyl-N-ethyl methacrylate ammonium bromide (A block)], from low molecular weight base polymer (charged $M_n$ of 3,945), poly [2-ethylhexyl methacrylate (B block)-co-N,N-dimethylamino-N-ethyl methacrylate (A block)], prepared in Example III and aqueous hydrogen bromide.

To a 1.0 liter Erlenmeyer flask were added 294.93 grams of a 50.86 weight percent toluene solution of the low molecular weight AB diblock copolymer (150.0 grams copolymer and 144.93 grams toluene) prepared in Example III as poly(2-ethylhexyl methacrylate-co-N,N-dimethylamino-N-ethyl methacrylate). The AB diblock copolymer is comprised of 18.23 weight percent of 2-dimethylaminoethyl methacrylate (DMAEMA) repeat units and 81.77 weight percent of 2-ethylhexyl methacrylate (EHMA) repeat units. The 150.0 grams of AB diblock copolymer contains 27.35 grams (0.174 mole) of DMAEMA repeat units. To this magnetically stirred AB diblock copolymer toluene solution at about 20° C. were added 28.73 grams of 48 percent aqueous hydrobromic acid. In 5 minutes following the hydrobromic acid addition, the temperature increased to 22° C. Then 23.4 grams of methanol were added which caused the reaction temperature (exotherm) to peak at 32° C. in another 5 minutes. The reaction mixture became very cloudy and viscous in 10 minutes after adding the methanol. Subsequently, an additional 150.0 grams of toluene were added, and after 0.5 hour the diluted reaction mixture clarified to a solution and became less viscous. The charged solids level was 32.95 weight percent, assuming a quantitative conversion of the targeted 98 mole percent DMAEMA repeat units present in the low molecular weight base polymer, to the HBr salt. This solution was magnetically stirred for about 20 hours at ambient temperature to give a low molecular weight protonated ammonium bromide AB diblock charge director solution of increased viscosity versus the solution of reactants at time zero. The moderately viscous solution was then diluted with NORPAR 15® (2,850.0 grams) to give a 5 weight percent (based on the corresponding starting weight of the AB diblock copolymer from Example III) charge director solution after toluene and methanol rotoevaporation. Toluene and methanol were rotoevaporated in 0.5 liter batches at 50° to 60° C. for 1.0 to 2.0 hours at 40 to 50 millimeters Hg. The 5 weight percent NORPAR 15® solution batches of poly(2-ethylhexyl methacrylate-co-N,N-dimethyl-N-ethyl methacrylate ammonium bromide) had conductivities in the range of 1,700 to 1,735 pmhos/centimeter and were used to charge the liquid toner in Control 1.

EXAMPLE VI

LOW MOLECULAR WEIGHT CHARGE DIRECTOR PREPARATION 2

Preparation of the low molecular weight protonated ammonium bromide AB diblock copolymer charge director, poly[2-ethylhexyl methacrylate (B block)-co-N,N-dimethyl-N-ethyl methacrylate ammonium bromide (A block)], from low molecular weight base polymer (charged $M_n$ of 3,945), poly[2-ethylhexyl methacrylate (B block)-co-N,N-dimethylamino-N-ethyl methacrylate (A block)], prepared in Example III and aqueous hydrogen bromide.

To a 4.0 liter Erlenmeyer flask were added 1,474.65 grams of a 50.86 weight percent toluene solution of the low molecular weight AB diblock copolymer (750.01 grams of copolymer and 724.64 grams of toluene) prepared in Example III as poly(2-ethylhexyl methacrylate-co-N,N-dimethylamino-N-ethyl methacrylate). The AB diblock copolymer was comprised of 18.23 weight percent of 2-dimethylaminoethyl methacrylate (DMAEMA) repeat units and 81.77 weight percent of 2-ethylhexyl methacrylate (EHMA) repeat units. The 750.01 grams of AB diblock copolymer contains 136.73 grams (0.870 mole) of DMAEMA repeat units. To this magnetically stirred AB diblock copolymer toluene solution at about 23° C. were added an additional 750.0 grams of toluene and 143.67 grams (0.852 mole of HBr) of 48 percent aqueous hydrobromic acid (Aldrich). Finally, 117.0 grams of methanol were added, and in the next 10 minutes following the methanol addition the exotherm peaked at 29° C. The charged solids level is 32.95 weight percent, assuming a quantitative conversion of the targeted 98 mole percent of DMAEMA repeat units present in the low molecular weight base polymer, to the HBr salt. This solution was magnetically stirred for about 67 hours at ambient temperature to give a low molecular weight protonated ammonium bromide AB diblock charge director solution of increased viscosity versus the solution of reactants at time zero. The moderately viscous solution were then diluted portion-wise with NORPAR 15®. To each 383.0 grams of low molecular weight protonated ammonium bromide AB diblock charge director solution was added 2,195.80 grams of NORPAR 15® to give a 5 weight percent, based on the corresponding starting weight (115.57 grams) of the AB diblock copolymer from Example III in each 383.0 grams, charge director solution after toluene and methanol rotoevaporation. Toluene and methanol were rotoevaporated in 0.5 liter batches at 50° to 60° C. for 1.0 to 1.5 hours at 40 to 50 millimeters Hg. The 5 weight percent NORPAR 15® solution batches of poly(2-ethylhexyl methacrylate-co-N,N-dimethyl-N-ethyl methacrylate ammonium bromide) had conductivities in the range of 1,810 to 2,060 pmhos/centimeter and were used to charge the liquid toner of Example VIII.

EXAMPLE VII

HIGH MOLECULAR WEIGHT CHARGE DIRECTOR PREPARATION 1

Preparation of the high molecular weight protonated ammonium bromide AB diblock copolymer charge director, poly[2-ethylhexyl methacrylate (B block)-co-N,N-dimethyl-N-ethyl methacrylate ammonium bromide (A block)], from high molecular weight base polymer (charged $M_n$ of 93,519), poly[2-ethylhexyl methacrylate (B block)-co-N,N-dimethylamino-N-ethyl methacrylate (A block)], prepared in Example IV and aqueous hydrogen bromide.

To a 250 milliliter Erlenmeyer flask were added 20.00 grams of a 48.14 weight percent toluene solution of the high molecular weight AB diblock copolymer (9.63 grams of copolymer and 10.37 grams of toluene) prepared in Example IV as poly(2-ethylhexyl methacrylate-co-N,N-dimethylamino-N-ethyl methacrylate). The AB diblock copolymer is comprised of 16.97 weight percent of 2-dimethylaminoethyl methacrylate (DMAEMA) repeat units and 83.03 weight percent of 2-ethylhexyl methacrylate (EHMA) repeat units. The 9.63 grams of AB diblock copolymer contains 1.64 grams (0.0104 mole) of DMAEMA repeat units. To this magnetically stirred AB diblock copolymer toluene solution at about 20° C. were added an additional 50.31 grams of toluene, 4.81 grams of methanol, and 0.82 gram (0.0102 mole of HBr) of 48 percent aqueous hydrobromic acid (Aldrich). The charged solids level was 13.6 weight percent assuming a quantitative conversion of the targeted 98 mole percent DMAEMA repeat units, present in the high molecular weight base polymer, to the HBr salt. This solution was magnetically stirred for 16 to 18 hours at ambient temperature to provide a very viscous but still magnetically stirrable high molecular weight protonated ammonium bromide AB diblock charge director solution. The viscous solution was then diluted with NORPAR 15® (182.97 grams) to provide a 5 weight percent (based on the corresponding starting weight of the AB diblock copolymer from Example IV) charge director solution after toluene and methanol rotoevaporation. Toluene and methanol were rotoevaporated at 60° to 65° C. for 1 hour at 40 to 50 millimeters Hg. The 5 weight percent NORPAR 15® solution of poly(2-ethylhexyl methacrylate-co-N,N-dimethyl-N-ethyl methacrylate ammonium bromide) had a conductivity of only 5.0 pmhos/centimeter and was selected to charge the liquid toner of Example VIII.

CONTROL 1

CYAN LIQUID DEVELOPERS CHARGED WITH THE LOW MOLECULAR WEIGHT PROTONATED AMMONIUM BROMIDE AB DIBLOCK COPOLYMER CHARGE DIRECTOR

Cyan liquid toner dispersions were prepared by selecting 28.05 grams of liquid toner concentrate (7.13 percent solids in NORPAR 15®) from Example I and adding to it sufficient NORPAR 15® and 5 percent low molecular weight (charged $M_n$ of 3,945) protonated ammonium bromide AB diblock charge director, poly[2-ethylhexyl methacrylate (B block)-co-N,N-dimethyl-N-ethyl methacrylate ammonium bromide (A block)], from Example V to provide about 1 percent solids wherein solids include resin, charge adjuvant, and pigment liquid toner dispersions containing 10, 30, 50, 70, and 90 milligrams or 1, 3, 5, 7, and 9 percent charge director per gram of toner solids (Controls 1A to 1E). The 5 percent low molecular weight protonated ammonium bromide AB diblock charge director was prepared from the low molecular weight base polymer prepared in Example III. After 2, 9, 34, and 295 days of equilibration, mobility and conductivity were measured for these 1 percent liquid toners to determine the toner charging rate and level. These values were compared to mobility and conductivity values obtained for the 1 percent cyan liquid toners described in Example VIII containing the high molecular weight protonated ammonium bromide AB diblock charge director prepared in Example VII blended with the low molecular weight protonated ammonium bromide AB diblock charge director prepared in Example VI. Table 1 in Example VIII contains 200 gram formulations for both sets of cyan liquid toners or developers charged with the low, and the blend of low and high molecular weight protonated ammonium bromide AB diblock copolymer charge directors. Table 2 in Example VIII contains the corresponding mobility and conductivity values for both sets of cyan liquid toners or developers.

EXAMPLE VIII

CYAN LIQUID DEVELOPERS CHARGED WITH A BLEND OF THE LOW AND HIGH MOLECULAR WEIGHT PROTONATED AMMONIUM BROMIDE AB DIBLOCK COPOLYMER CHARGE DIRECTORS

Cyan liquid toner dispersions were prepared by selecting 27.51 grams of liquid toner concentrate (7.27 percent solids in NORPAR 15®) from Example II and adding to it sufficient NORPAR 15® and 5 percent low and high molecular weight (charged $M_n$ of 3,945 and 93,519, respectively) protonated ammonium bromide AB diblock charge director, poly[2-ethylhexyl methacrylate (B block)-co-N,N-dimethyl-N-ethyl methacrylate ammonium bromide (A block)], from Examples VI and VII, respectively, to provide 1 percent solids wherein solids include resin, charge adjuvant, and pigment liquid toner dispersions containing a total of 100 milligrams or 10 percent charge director per gram of toner solids (Examples VIA to VIE) in various blend weight ratios. The 5 percent low molecular weight protonareal ammonium bromide AB diblock charge director was prepared from low molecular weight base polymer in Example III, and the 5 percent high molecular weight protonated ammonium bromide AB diblock charge director was prepared from high molecular weight base polymer in Example IV. After 1, 7, 28 and 165 days of equilibration, mobility and conductivity were measured for these 1 percent liquid toners to determine the toner charging rate and level. These values were compared to mobility and conductivity values obtained for the 1 percent cyan liquid toners described in Control 1. Table 1 contains 200 gram formulations for both sets of cyan developers charged with (1) the low molecular weight protonated ammonium bromide AB diblock copolymer charge director, and (2) the low and high molecular weight protonated ammonium bromide AB diblock copolymer charge director blend. Table 2 contains the corresponding mobility and conductivity values for both sets of cyan liquid toners or developers.

A review of Table 2 indicates that liquid toners (Examples VIIIA to VIIIE) charged at 100 milligrams of charge director per gram of toner solids with blends of the low and high molecular weight protonated ammonium bromide AB diblock copolymer charge directors show a well-defined decrease in conductivity as the low molecular weight copolymer charge director concentration in the blend is decreased and the high molecular weight copolymer charge director concentration in the blend is increased. In contrast, the control liquid toners (Controls 1A to 1E) in Table 2 show a steady increase in conductivity with increasing charging levels, 10 to 90 milligrams of charge director per gram of toner solids, of the low molecular weight protonated ammonium bromide AB diblock copolymer charge director, which is the only charge director used in Control 1. Clearly, the conductivity results observed in Table 2 for both the Control and the Comparative Example indicate that the low molecular weight protonated ammonium bromide AB diblock copolymer charge director is solely responsible for the rapidly increasing conductivity in the developers charged with the blended charge directors. Developer conductivity can be selected at any desired level by the appropriate blending of the low and high molecular weight charge directors without decline in toner charging level.

TABLE 1

Cyan Liquid Developer Formulations Charged with Low Molecular Weight Protonated Ammonium Bromide AB Diblock Copolymer Charge Director and a Blend of Low and High Molecular Weight Protonated Ammonium Bromide AB Diblock Copolymer Charge Director

| Developer: Control or Example No. | Grams: Toner Concentrate From Exams. I and II | Grams: Added NORPAR 15 ® | Grams: Added 5% Charge Director (Cb) in NORPAR ® Low/High $M_n$ | CD Preparation Example No. & CD Level in mg CD/g Toner Solids |
|---|---|---|---|---|
| Control 1A | 28.05 | 171.55 | 0.0/0.0 | Example V: 10/1 Low $M_n$ |
| Control 1B | 28.05 | 177.48 | 1.2/0.0 | Example V: 30/1 Low $M_n$ |
| Control 1C | 28.05 | 169.95 | 2.0/0.0 | Example V: 50/1 Low $M_n$ |
| Control 1D | 28.05 | 169.15 | 2.8/0.0 | Example V: 70/1 Low $M_n$ |
| Control 1E | 28.05 | 168.35 | 3.6/0.0 | Example V: 90/1 Low $M_n$ |
| Example VIIIA | 27.51 | 168.49 | 4.0/0.0 | Exam. VI: 100/1 Low $M_n$ Exam. VII: 0/1 High $M_n$ |
| Example VIIIB | 27.51 | 168.49 | 3.0/1.0 | Exam. VI: 75/1 Low $M_n$ Exam. VII: 25/1 High $M_n$ |
| Example VIIIC | 27.51 | 168.49 | 2.0/2.0 | Exam. VI: 50/1 Low $M_n$ Exam. VII: 50/1 High $M_n$ |
| Example VIIID | 27.51 | 168.49 | 1.0/3.0 | Exam. VI: 25/1 Low $M_n$ Exam. VII: 75/1 High $M_n$ |
| Example VIIIE | 27.51 | 168.49 | 0.0/4.0 | Exam. VI: 0/1 Low $M_n$ Exam. VII: 100/1 High $M_n$ |

TABLE 6

Mobility and Conductivity Results for Cyan Liquid Developers Charged with Low Molecular Weight Protonated Ammonium Bromide AB Diblock Copolymer Charge Director and a Blend of Low and High Molecular Weight Protonated Ammonium Bromide AB Diblock Copolymer Charge Director

| Developer: Control or Example No. | Aging: Time in Days | CD Level: mg CD/g Toner Solids | Mobility: $E^{-10}$ $m^2$/Vs | Cond: pmho/cm | Comments |
|---|---|---|---|---|---|
| Control 1A | 2 | 10/1 Low | −1.35 | 3 | Low Charging/ |
| | 9 | $M_n$ AB | −1.65 | 3 | Very Low |
| | 34 | Diblock | −1.52 | 3 | Cond. Due to |
| | 295 | Copolymer | −0.21 | 2 | Low CD Level |
| Control 1B | 2 | 30/1 Low | −1.44 | 8 | High |
| | 9 | $M_n$ AB | −1.85 | 8 | Charging/Low |
| | 34 | Diblock | −1.86 | 8 | Cond.; Slow |
| | 295 | Copolymer | −2.52 | 7 | Charging Rate |
| Control 1C | 2 | 50/1 Low | −1.60 | 15 | High |
| | 9 | $M_n$ AB | −1.72 | 14 | Charging/ |
| | 34 | Diblock | −2.03 | 16 | Moderate |
| | 295 | Copolymer | −2.52 | 14 | Conductivity/ Slow Charging Rate |
| Control 1D | 2 | 70/1 Low | −1.37 | 21 | High Charging/ |
| | 9 | $M_n$ AB | −1.56 | 20 | High Cond./ |
| | 34 | Diblock | −1.71 | 23 | Slow Charging |
| | 295 | Copolymer | −2.34 | 21 | Rate |
| Control 1E | 2 | 90/1 Low | −1.30 | 28 | High |
| | 9 | $M_n$ AB | −1.64 | 26 | Charging/Very |
| | 34 | Diblock | −1.65 | 29 | High Cond./ |
| | 295 | Copolymer | −2.50 | 29 | Slow Charging Rate |
| Example VIIIA | 1 | 100/1 Low $M_n$ AB | −2.14 | 38 | High Charging/ |
| | 7 | and 0/1 High $M_n$ | −2.27 | 38 | Extremely |
| | 28 | AB Diblock | −2.39 | 35 | High Cond./ |
| | 165 | Copolymers | −2.55 | 32 | Rapid Charging Rate |
| Example VIIIB | 1 | 75/1 Low $M_n$ AB | −2.14 | 29 | High |
| | 7 | and 25/1 High $M_n$ | −2.25 | 28 | Charging/Very |
| | 28 | AB Diblock | −2.34 | 25 | High Cond./ |
| | 165 | Copolymers | −2.68 | 24 | Rapid Charging Rate |
| Example VIIIC | 1 | 50/1 Low $M_n$ AB | −2.28 | 19 | High |
| | 7 | and 50/1 High $M_n$ | −2.27 | 18 | Charging/ |
| | 28 | AB Diblock | −2.43 | 16 | Moderate |
| | 165 | Copolymers | −2.68 | 15 | Cond./Rapid Charging Rate |

TABLE 6-continued

Mobility and Conductivity Results for Cyan Liquid Developers Charged with Low Molecular Weight Protonated Ammonium Bromide AB Diblock Copolymer Charge Director and a Blend of Low and High Molecular Weight Protonated Ammonium Bromide AB Diblock Copolymer Charge Director

| Developer: Control or Example No. | Aging: Time in Days | CD Level: mg CD/g Toner Solids | Mobility: $E^{-10}$ $m^2$/Vs | Cond: pmho/cm | Comments |
|---|---|---|---|---|---|
| Example VIIID | 1 | 25/1 Low $M_n$ AB | −2.13 | 11 | High Charging |
| | 7 | and 75/1 High $M_n$ | −2.09 | 10 | Low to |
| | 28 | AB Diblock | −2.15 | 8 | Moderate |
| | 165 | Copolymers | −2.56 | 7 | Cond./Rapid Charging Rate |
| Example VIIIE | 1 | 0/1 Low $M_n$ AB | −2.06 | 2 | High Charging/ |
| | 7 | and 100/1 High $M_n$ | −2.24 | 2 | Very Low |
| | 28 | AB Diblock | −2.60 | 2 | Cond./Rapid |
| | 165 | Copolymers | −2.78 | 2 | Charging Rate |

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer consisting essentially of a liquid, thermoplastic resin particles, optional pigment, a nonpolar liquid soluble charge director comprised of an ionic or zwitterionic quaternary ammonium block copolymer, and wherein said charge director possesses a molecular weight distribution that is bimodal comprising a first AB diblock copolymer with a number average molecular weight of from about 70,000 to about 200,000, and a second AB diblock copolymer with a number average molecular weight of from about 2,200 to about 60,000.

2. A developer according to claim 1 further containing a colorant.

3. A developer according to claim 2 wherein the colorant is a pigment or a dye.

4. A developer in accordance with claim 3 wherein the pigment is cyan, magenta, yellow, red, green, blue, brown, or mixtures thereof; or carbon black.

5. A developer in accordance with claim 1 wherein said first AB diblock copolymer and said second AB diblock copolymer is selected from the group consisting of poly[2-trimethylammoniumethyl methacrylate bromide co-2-ethylhexyl methacrylate], poly[2-triethylammoniumethyl methacrylate hydroxide co-2-ethylhexyl methacrylate], poly[2-trimethylammoniumethyl methacrylate chloride co-2-ethylhexyl methacrylate], poly[2-trimethylammoniumethyl methacrylate fluoride co-2-ethylhexyl acrylate], poly[2-trimethylammoniumethyl acrylate p-toluenesulfonate co-2-ethylhexyl methacrylate], poly[2-trimethylammoniumethyl acrylate nitrate co-2-ethylhexyl acrylate], poly[2-triethylammoniumethyl methacrylate phosphate co-2-ethylhexyl acrylate], poly[2-triethylammoniumethyl acrylate bromide co-2-ethylhexyl acrylate], poly[2-trimethylammoniumethyl methacrylate hydroxide co-2-ethylhexyl acrylate], poly[2-trimethylammoniumethyl acrylate hydroxide co-2-ethylhexyl acrylate], poly[2-trimethylammoniumethyl methacrylate hydroxide co-N,N-dibutyl methacrylamide], poly[2-triethylammoniumethyl methacrylate chloride co-N,N-dibutyl methacrylamide], poly[2-trimethylammoniumethyl methacrylate bromide co-N,N-dibutylacrylamide], poly[2-triethylammoniumethyl methacrylatehydroxide co-N,N-dibutylacrylamide], poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl methacrylate tosylate co-2-ethylhexyl acrylate, poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

6. A developer in accordance with claim 1 with a mobility of from 2.09 E-10 to 2.68 E-10 meters squared volts per second, and a conductivity of 7 to 11.

7. A negatively charged liquid developer consisting of a nonpolar liquid, thermoplastic resin particles, pigment, a charge adjuvant pigment, and a nonpolar liquid soluble polymeric ionic charge director comprised of an ionic or zwitterionic ammonium block copolymer, and wherein the molecular weight distribution of said charge director is bimodal comprising a first AB diblock copolymer with a number average molecular weight of from about 70,000 to about 200,000, and a second AB diblock copolymer with a number average molecular weight of from about 2,200 to about 60,000.

8. A developer in accordance with claim 7 wherein the resin particles are comprised of a copolymer of ethylene and an $\alpha,\beta$-ethylenically unsaturated acid selected from the group consisting of acrylic acid and methacrylic acid, or mixtures thereof.

9. A developer in accordance with claim 7 wherein the resin particles are comprised of a styrene polymer, an acrylate polymer, a methacrylate polymer, a polyester, or mixtures thereof.

10. A developer in accordance with claim 7 wherein the resin particles are comprised of a copolymer of ethylene and acrylic acid, ethylene and methacrylic acid, ethylene and an alkyl ester of acrylic acid, or ethylene and an alkyl ester of methacrylic acid.

11. A developer in accordance with claim 7 wherein the charge director is present in an amount of from about 1 percent to about 20 percent of developer solids and there is enabled a negatively charged toner.

12. A developer in accordance with claim 7 wherein the liquid is an aliphatic hydrocarbon.

13. A developer in accordance with claim 12 wherein the aliphatic hydrocarbon is a mixture of branched hydrocarbons with from about 12 to about 16 carbon atoms.

14. A developer in accordance with claim 12 wherein the aliphatic hydrocarbon is a mixture of normal hydrocarbons with from about 12 to about 16 carbon atoms.

15. A developer in accordance with claim 7 wherein the resin particles are comprised of an alkylene polymer, a styrene polymer, an acrylate polymer, a polyester, or mixtures thereof.

16. A developer in accordance with claim 7 wherein the number average molecular weight of the charge director first component is from about 80,000 to about 150,000, and the number average molecular weight of the second component is from about 3,000 to about 20,000.

17. A developer in accordance with claim 16 wherein said developer possesses high developer toner charge thereby enabling developer particle mobilities that range from about 2.0 E-10 $m^2$/vs to about 5.0 E-10 $m^2$/Vs.

18. A developer in accordance with claim 16 with a low conductivity at 1 percent developer solids of from about 1 ps/centimeter to about 5 ps/centimeter.

19. A developer in accordance with claim 7 wherein the number average molecular weight of said first AB diblock copolymer is from about 85,000 to about 100,000, and the average number molecular weight of said second AB diblock copolymer is from about 4,000 to about 10,000.

20. A developer in accordance with claim 7 wherein the ratio of high $M_n$, the number average molecular weight of the first AB diblock copolymer over the low number average molecular weight second AB diblock copolymer is from about 95/5 to about 50/50.

21. A negatively charged liquid electrostatographic developer consisting essentially of a nonpolar liquid, thermoplastic resin particles, pigment, a charge adjuvant, and a nonpolar liquid soluble polymeric ionic charge director comprised of an ionic or zwitterionic ammonium block copolymer, and wherein the molecular weight distribution of said charge director is bimodal and comprises an AB block copolymer with a number average molecular weight of from about 70,000 to about 200,000, and a second an AB block copolymer with a number average molecular weight of from about 2,200 to about 60,000, and with ratios of the high $M_n$ to the low $M_n$ components of from about 99/1 to about 10/90.

22. A developer in accordance with claim 21 wherein the resin is comprised of a copolymer of ethylene and vinyl acetate, polypropylene, polyethylene, acrylic polymers, or mixtures thereof.

23. A liquid electrostatographic developer consisting essentially of (A) a nonpolar liquid having a Kauri-butanol value of from about 5 to about 30 and present in a major amount of from about 50 percent to about 95 weight percent; (B) thermoplastic resin particles and pigment particles; (C) a nonpolar liquid soluble polymeric charge director comprised of an ionic or zwitterionic ammonium block copolymer with a bimodal $M_n$ distribution comprising a first AB diblock copolymer with a number average molecular weight of from about 70,000 to about 200,000, and a second AB diblock copolymer with a number average molecular weight of from about 2,200 to about 60,000; and (D) a charge adjuvant.

24. A developer in accordance with claim 23 wherein the charge adjuvant is aluminum stearate.

25. A developer in accordance with claim 23 wherein component (A) is present in an amount of from 85 percent to 99.9 percent by weight based on the total weight of the developer solids of resin, pigment, and charge adjuvant which is present in an amount of from about 0.1 percent to about 15 percent by weight based on the weight percent of said developer solids; and component (C) is present in an amount of from about 0.5 percent to about 100 percent of the developer solids comprised of resin, pigment, and charge adjuvant.

26. A developer in accordance with claim 23 wherein component (D) is present in an amount of 0.1 to 40 percent by weight based on the total weight of developer solids.

27. An imaging method which comprises forming an electrostatic latent image followed by the development thereof with a negatively charged liquid developer consisting essentially of a nonpolar liquid, thermoplastic resin particles, pigment, a charge adjuvant pigment, and a nonpolar liquid soluble polymeric ionic charge director comprised of an ionic or zwitterionic ammonium block copolymer, and wherein the molecular weight distribution of said charge director is bimodal comprising a first AB diblock copolymer with a number average molecular weight of from about 70,000 to about 200,000, and a second AB diblock copolymer with a number average molecular weight of from about 2,200 to about 60,000.

28. An imaging method which comprises forming an electrostatic latent image followed by the development thereof with a liquid electrostatic developer comprised of (A) a nonpolar liquid having a Kauri-butanol value of from about 5 to about 30 and present in a major amount of from about 50 percent to about 95 weight percent; (B) thermoplastic resin particles and pigment particles; (C) a nonpolar liquid soluble polymeric charge director comprised of an ionic or zwitterionic ammonium block copolymer with a bimodal $M_n$ distribution comprising a first AB diblock copolymer with a number average molecular weight of from about 70,000 to about 200,000, and a second AB diblock copolymer with a number average molecular weight of from about 2,200 to about 60,000; and (D) a charge adjuvant.

* * * * *